US005156555A

United States Patent [19]

Mohs et al.

[11] Patent Number: 5,156,555

[45] Date of Patent: Oct. 20, 1992

[54] ELECTRICAL CONNECTION DEVICE

[75] Inventors: Wolfgang Mohs, Menden; Georg Schröder, Drolshagen; Maximilian Gröbmair, Dietramszell; Alfred Krappel, Ismaning; Robert Albiez, Reichertshofen; Rudolf Fekonja, München, all of Fed. Rep. of Germany

[73] Assignee: Leopold Kostal GmbH & Co., Fed. Rep. of Germany

[21] Appl. No.: 746,638

[22] Filed: Aug. 19, 1991

[30] Foreign Application Priority Data

Aug. 23, 1990 [DE] Fed. Rep. of Germany ..... 4026644
Jul. 12, 1991 [DE] Fed. Rep. of Germany ..... 4123116

[51] Int. Cl.[5] ..... H01R 13/20
[52] U.S. Cl. ..... 439/161; 439/839
[58] Field of Search ..... 439/161, 821, 839, 854

[56] References Cited

U.S. PATENT DOCUMENTS

| | | | |
|---|---|---|---|
| 4,009,924 | 3/1977 | Bungo et al. | 439/839 |
| 4,136,922 | 1/1979 | Grebik | 439/854 X |
| 4,412,718 | 11/1983 | Pfister | 439/839 |
| 4,497,527 | 2/1985 | Cameron | 439/161 |
| 4,634,201 | 1/1987 | Kemka | 439/161 |
| 5,021,011 | 6/1991 | Kawanami et al. | 439/839 X |

*Primary Examiner*—Larry I. Schwartz
*Assistant Examiner*—Khiem Nguyen
*Attorney, Agent, or Firm*—Brooks & Kushman

[57] ABSTRACT

A connection device consisting basically of a socket member (1) exhibiting a termination area (2) for the connection of an electric cable and a contact area (4) joined to it by means of a base (1*a*), the contact area being in the form of tines and intended to receive and hold a mating pin (3), and of a separate driver member (5) in the form of a closed ring which is preferably manufactured of heat recoverable material. In order to create an electrical connection device where the driver member being retained against the contact area, creates both a mechanical force and keyed-in connection between the socket member and the mating pin when in its second functional position, a recess which is at least partial formed into the mating pin, and the tines and driver member are formed and positioned relative to each other in such a way that the driver element partially fits into the recess when in its second functional position. In addition, when using a driver member of heat recoverable material, it is advantageous if at least one locking element is provided which prevents unwanted actuation of the driver element when locked, while permitting appropriate actuation when released.

17 Claims, 2 Drawing Sheets

ELECTRICAL CONNECTION DEVICE

BACKGROUND OF THE INVENTION

This invention relates, generally, to an electrical connection device. More particularly, it relates to an electrical connection device of the type including an electrical socket member and an electrical mating pin.

Connection devices of this type, consisting of male and female connector parts, provide extremely secure electrical connections which can only be disengaged with considerable effort.

Such a connection device has been disclosed in GB 2 128 039 A. The contact area of the connector socket, intended to accept a round mating pin, exhibits four tines. An annular groove formed into the tines retains a driver member made of heat-recoverable metal against the contact area of the socket so that the driver member cannot become detached.

In its second functional position, after inward recovery, the driver member shrinks to exert pressure on the tines and thus to form a pressure connection between the tines and the mating pin.

The present invention aims to improve on this system by creating an electrical connection device in which the driver member creates a keyed-in as well as a pressure connection between the socket and the mating pin.

The particular advantage of the improved system lies in the fact that, in addition to the high electrical contact reliability assured by the high contact pressure exercised through the driver members, the keyed-in system offers extra high resistance to unwanted disengagement resulting from mechanical loads such as push-pull forces or vibration.

Furthermore, it is particular advantageous to provide a connection device which includes a heat-recoverable driver member with a locking means which is able to prevent the driver element from acting on the device before it is appropriate.

This locking means prevents the driver element from shrinking and therefore narrowing the socket should it be exposed to heat during, for example, shipping or storage, and therefore guarantees that the mating pin can still be inserted easily when desired.

It is, of course, also possible to incorporate such a locking means into a connection device whose mating pin does not exhibit a groove for the reception of the driver element. Such an application would remain within the framework of this patent.

Accordingly, it is the object of the invention to provide a new and improved electrical connection device of the type including an electrical socket member and an electrical mating pin.

Other objects and features of the invention will become apparent from the following description when read in conjunction with the following drawings.

DETAILED DESCRIPTION OF THE PREFERRED EMBODIMENT

Figure 1A:
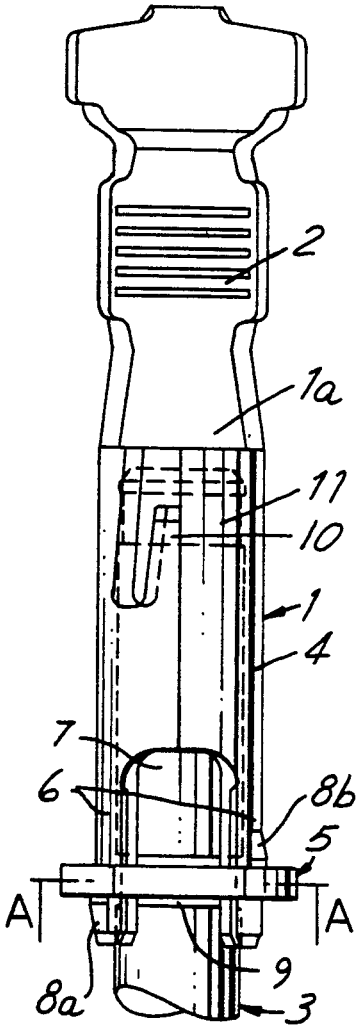
FIG. 1*a* shows an electrical connection device with the driver element in its second functional position after recovery.

As can be seen from the drawings, an electrical connection device of the type described here includes a socket member 1, generally manufactured by means of stamping and bending processes which exhibits a termination area 2 for the connection of an electrical cable connected via a base 1*a* to a contact area 4 intended to receive a mating pin 3. The contact area 4 also is provided with a separate driver member 5 of heat recoverable material in the form of a closed ring.

Figure 1B:
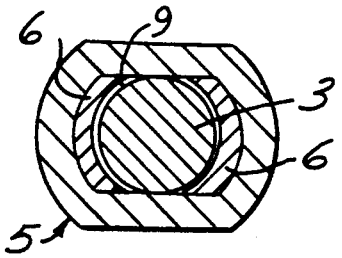
FIG. 1*b* is a cross section of the device taken through the line A—A shown in FIG. 1*a*.

A first embodiment of a connecting device according to the present invention will now be described. As shown particularly in FIGS. 1*a* and 1*b*, the contact area 4 of socket member 1 exhibits a round cross-section and is intended to receive a round mating pin 3. The socket member 1 and its termination area 2 and contact area 4 all lie in an axial plane. Contact area 4 exhibits two basically rectangular tines 6 which are adapted cylindrically to the round contour of mating pin 3. Tines 6 are produced by the stamping-out of two basically rectangular cutouts 7 extending from the end opening of contact area 4.

Cutouts 7 are dimensioned in such a way that the width of each tine 6 is at least slightly less than the diameter of mating pin 3.

Driver member 5 is retained against contact area 4 by retaining wedges 8 formed onto tines 6 so that driver member 5 cannot be detached. Each of the two tines 6 exhibits a first wedge 8*a* with its widest part facing towards termination area 2 and a second wedge 8*b* which has its widest part facing towards the open end of socket member 1. Driver member 5 surrounds contact area 4 approximately one third of the way up tines 6, measured from the end which is opposite the termination area. Both shorter sides of the oval-shaped driver member 5 lie against a tine 6, the tines lying opposite each other. Mating pin 3 is provided with an annular recess 9 in the form of a continuous groove around its circumference. Both long sides of driver member 5 partially fit into annular recess 9. The depth of annular recess 9 is such that driver member 5 does not rest on the bottom of it when in its second functional position, shown in FIGS. 1*a* and 1*b*.

At the end of socket member 1 which is nearest termination area 2 there is a retaining tongue 10, which fits into an equivalent tongue recess 11 in mating pin 3.

In order to create a connection device such as that described here, the closed-ring oval driver member 5 of heat-recoverable metal is brought into its first functional position by means of stretching. The stretched driver member 5 is pushed onto the contact area 4 of socket member 1 from the end which lies opposite the termination area. In this process, driver member 5 must be pushed over the first retaining wedges 8*a*, which in turn pushes the tines 6 towards each other. When driver member 5 comes to rest against the second retaining wedges 8*b*, both tines 6 spring back to their original position, so that driver member 5 cannot slip from its intended position round contact area 4, between wedges 8*a* and 8*b*.

In this first functional position, contact area 4 is only loosely surrounded by driver member 5, i.e. driver member 5 is so dimensioned as to be slightly larger in circumference than socket member 1. No pressure is therefore exerted on tines 6.

Socket member 1 with driver member 5 is then aligned with mating pin 3 so that electrical contact can be made. In order to secure optimum contact, socket member 1 is pushed over mating pin 3 until retaining tongue 10 fits into tongue recess 11.

At this stage mating pin 3 and socket member 1 are ready for final connection. Now driver member 5 is heated with a suitable heating means, whereby driver member 5 recovers inwardly to assume its original form. During and after the recovery, the two shorter sides of oval driver member 5 are pressed hard against tines 6, so that these in turn press hard against mating pin 3. In addition, the two longer sides of driver member 5 fit partially into annular recess 9 in mating pin 3.

By means of this process a two fold mechanical connection is formed between mating pin 3 and socket member 1—on the one hand a pressure connection, and on the other hand a keyed-in connection.

Figure 2A:
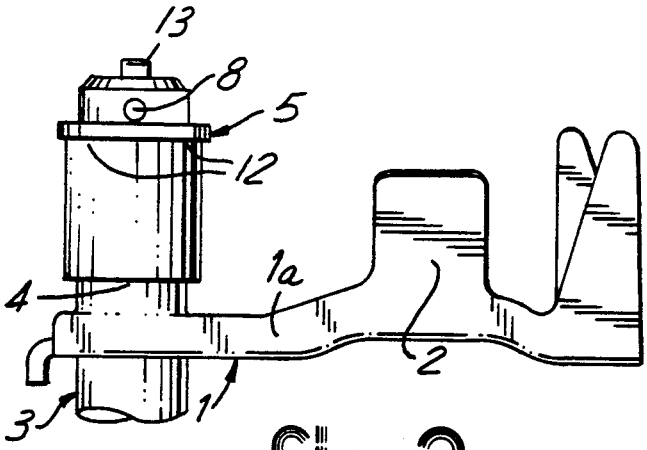
FIG. 2*a* is a schematic side view of a further electrical connection device with the driver element in its second functional position after recovery.
Figure 2B:
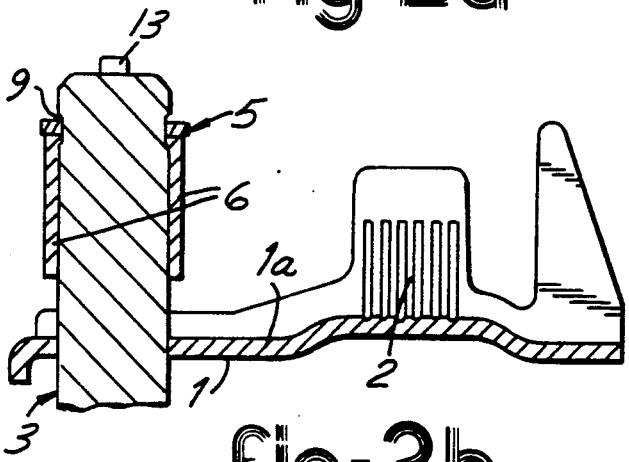
FIG. 2*b* is a cross-section of the device originally shown in 2*a*.
Figure 2C:
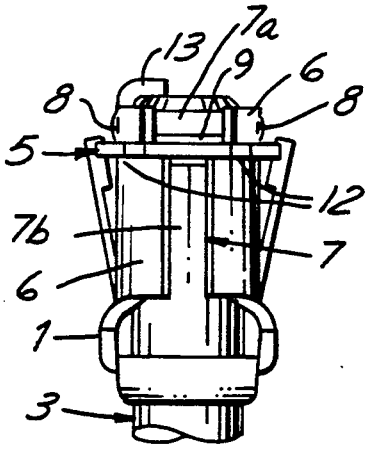
FIG. 2*c* is a frontal view of the device originally shown in 2*a*.

In FIGS. 2*a*, 2*b* and 2*c*, there is illustrated a second embodiment of the invention. Contact area 4 of socket member exhibits a round cross section and is intended to receive an equivalent mating pin 3 with round cross section. Socket member 1 consists of a termination area 2 for the connection of an electrical cable extending in a radial direction and a contact area 4 extending axially away from base section 1*a* of termination area 2.

Contact area 4 consists principally of two longitudinal tines 6, whose contour is adapted to the round cross section of mating pin 3. The two tines 6 are formed by the stamping-out of basically rectangular cutouts 7. Starting from that end of contact area 4 which is not directly joined to base section, 1*a*, the initial portions 7*a* of cutouts 7 are dimensional in such a way that the width of each tine is at least slightly less than the diameter of mating pin 3. Continuing towards the end which is joined to base section 1*a*, further portions 7*b* of cutouts 7 follow which are so dimensioned that the width of each tine is considerably greater than the diameter of mating pin 3.

The beginnings of the wider parts of tines 6 serve as stops 12 for driver member 5 and thus define its position.

Each of the two tines 6 exhibits a retaining wedge or lobe 8, formed onto the tines and facing outward. Driver member 5 is securely retained at contact area 4 between retaining lobes 8 and stops 12. Tines 6 are shaped in such a way that driver member 5 is held near that end of contact area 4 which is not directly joined to base section 1*a*, each shorter side of oval driver member 5 lies against one of the two tines, which face each other. Mating pin 3 exhibits an annular recess 9 in the form of a groove. Both longer sides of driver member 5 partially fit into annular recess 9. The depth of annular recess 9 is such that driver member 5 does not rest on the bottom of it when in its second functional position, shown in FIGS. 2*a*, 2*b* and 2*c*.

A stop tab 13 is formed onto the end of contact area 4 which is not directly joined to base section 1*a* which limits the depth of insertion of mating pin 3.

In order to create a connection device of this second type described here, the closed-ring oval driver member 5 of heat-recoverable material is brought into its first functional position by means of stretching. The stretched driver member 5 is pushed onto the contact area 4 of socket member 1 from the end which is not directly joined to base section 1*a*. In this process, driver member 5 must be pushed over retaining lobes 8, which in turn pushes the tines 6 towards each other. When driver member 5 comes to rest against stops 12, both tines 6 spring back to their original position, so that driver member 5 cannot slip from its intended position around contact area 4, between stops 12 and retaining lobes 8.

In this first functional position, contact area 4 is only loosely surrounded by driver member 5, i.e. driver member 5 is so dimensioned as to be slightly larger in circumference than socket member 1.

No pressure is therefore exerted on tines 6. Socket member 1 with driver member 5 is then aligned with mating pin 3 so that electrical contact can be made. In order to secure optimum contact, socket member 1 is pushed from its base 1*a* onto mating pin 3 until the end of mating pin 3 comes to rest against stop tab 13 at the opposite end of the socket members 1. The inherent resilience of tines 6 holds socket member 1 on mating pin 3. Now driver member 5 is heated with a suitable heating means, whereby driver member 5 recovers inwardly to assume its original form.

During and after the recovery, the two shorter sides of oval driver member 5 are pressed hard against tines 6, so that these in turn press hard against mating pin 3. In addition, the two long sides of driver member 5 partially fit into annular recess 9 in mating pin 5. By means of this process a twofold mechanical connection is formed between mating pin 3 and socket member 1—on the one hand a pressure connection, and on the other hand a keyed-in connection.

Driver member 5 can also of course take the form of a mechanical clamping device, such as a clamping ring or clamping blocks.

A description of a third embodiment of the invention follows, as shown in FIGS. 3*a*, 3*b*, 3*c*, 3*d* and 3*e*. The cross section of the contact area 4 of electrical socket member 1 consists of two sections of a ring and is intended to make contact with mating pin 3, which has a suitable circular cross section. Socket member 1 consists of a termination area 2 for the connection of an electrical cable running in a direction which is radial in relation to mating pin 3, and a contact area 4 extending axially away from the base section 1*a* of termination area 2. Contact area 4 consists basically of two longitudinal tines 6, which are adapted to the round contour of mating pin 3 and formed by the stamping out of basically rectangular cutouts 7. Starting from that end of contact area 4 which is not directly joined to base section 1*a*, the initial portions of cutouts 7*a* are dimensioned in such a way that the width of each tine is at least slightly less than the diameter of mating pin 3. Continuing towards, the end which is joined to base section 1*a*, a further portion 7*b* follows where cutouts 7 are dimensioned so that the width of each tine is considerably greater than the diameter of mating pin 3. The beginnings of the wide parts of tines 6 serve as stops 12 for driver member 5 and thus define its position.

Each of the two tines 6 exhibits a retaining lobe 8, formed onto the tines and facing outward. Driver member 5 is securely held at contact area 4 between retaining lobes 8 and stops 12. Tines 6 are shaped in such a way that driver member 5 is held near that end of contact area 4 which is not directly joined to base section 1*a*. Each shorter side of driver member 5 lies against one of the two tines, which face each other. Mating pin 3 exhibits an annular recess 9 in the form of a groove. Both longer sides of driver member 5 partially fit into annular recess 9. A locking element 14 is formed onto the end of each of the tines in one piece. These locking elements 14 are finger-shaped and their ends meet directly when in the locked position.

Figure 3A:
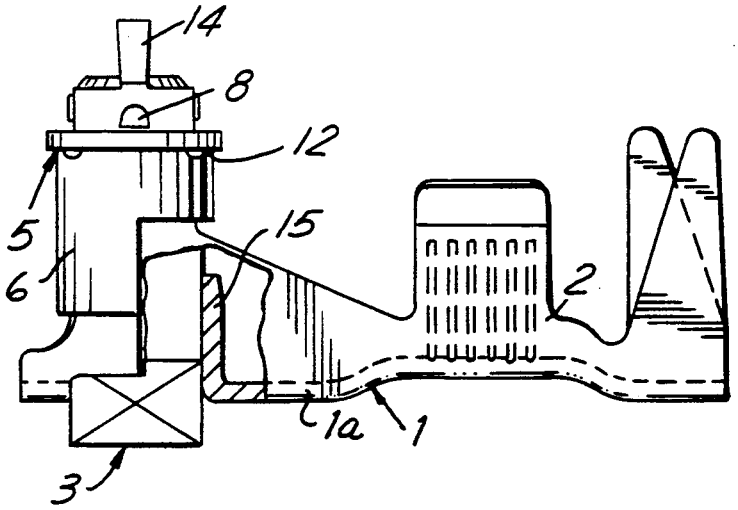
FIG. 3*a* is a partially cross-sectioned side view of a third electrical connection device.
Figure 3B:
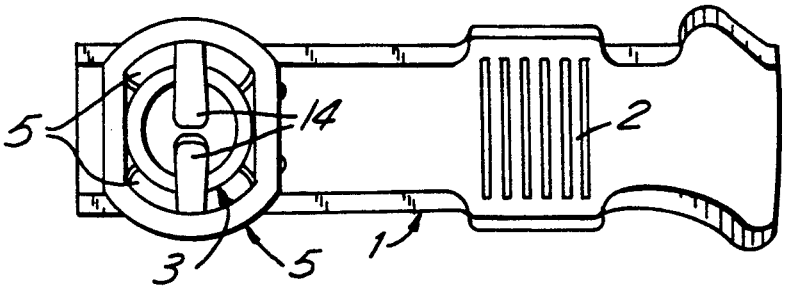
FIG. 3*b* is a birds-eye view of the device originally shown in 3*a*.
Figure 3C:
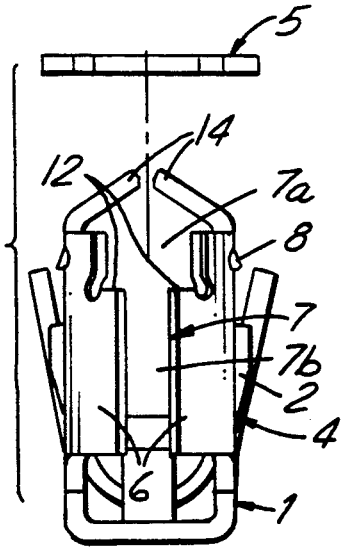
FIG. 3*c* is a frontal view of the device originally shown in 3*a*, with its locking element open and with the driver member detached.
Figure 3D:
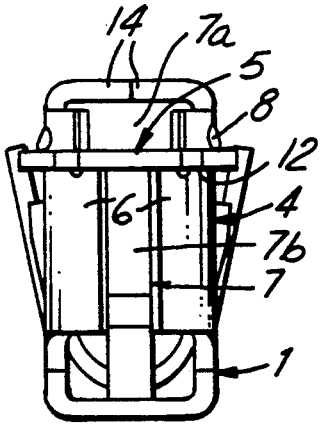
FIG. 3*d* is a frontal view of the device originally shown in 3*a*, with its locking element in the locked position and with the driver member attached.

In order to create a connection device of this third type, the closed-ring oval driver member 5 of heat-recoverable material is enlarged by stretching. It is then pushed onto the contact area 4 of socket member 1 from the end which is not directly joined to base section 1*a*. As can be seen in FIG. 3*c*, locking elements 14 are initially positioned at an angle to socket member 1 so that they serve as a guide and assembly aid for driver member 5. Driver member 5 must first be pushed over retaining lobes 8, which in turn pushes tines 6 towards each other. When driver member 5 then comes to rest against stops 12, both tines 6 spring back into their original position and driver member 5 is held securely against contact area 4 between stops 12 and retaining lobes 8. Now, as can be seen in FIG. 3*d*, locking elements 14 are bent back in such a way that their free ends come to rest directly against one another. This is the locked position. In this first functional position, contact area 4 is loosely surrounded by driver member 5, which means that no pressure is exerted on tines 6 under normal circumstances. If, however, temperatures of, for example, over 75° C. are encountered during storage or transport of the connectors, the inward recovery process of driver member 5 is initiated. Locking elements 14 in their locked position prevent driver member 5 from shrinking in response to the higher temperatures and therefore also prevent any compression of contact area 4. Locking elements 14 are formed in such a way that they particularly prevent shrinking of the long sides of oval driver member 5.

Equipped with locking elements 14, socket member 1 can be easily connected to mating pin 3, even if the heat recovery process of driver member 5 has already been initiated. In order to secure optimum contact, socket member 1 is pushed from its base onto mating pin 3 until the end of mating pin 3 comes to rest against the underside of locking elements 14. Socket member 1 is held precisely in position over mating pin 3 by means of the inherent resilience of tines 6 and retaining extensions 15 which are formed onto base 1. Retaining extensions 15 fit into an equivalent recess in mating pin 3.

Figure 3E:
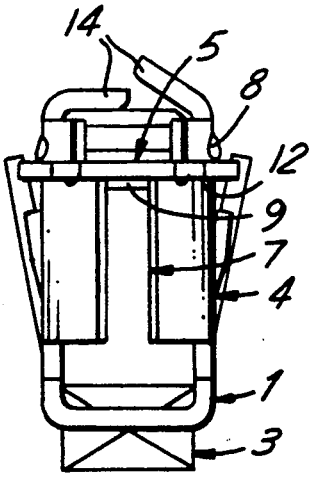
FIG. 3*e* is a frontal view of the device originally shown in 3*a*, with the mating pin inserted and with its locking element open to permit the driver member to exert pressure on the mating pin.

As can be particularly seen in the FIG. 3*e*, the locked position of locking elements 14 is now released by taking the ends of locking elements 14 out of direct alignment. In order to achieve this, at least one of locking elements 14 is bent. If the inward recovery process of driver member 5 should already have been initiated as described above, its inherent force will now be freed to act on tines 6, pressing them against mating pin 3. However, driver member 5 is in any case now finally subjected to temperatures well above 75° C., which continues inward recovery process. The two shorter sides of driver member 5 are pressed hard against tines 6, so that these in turn press hard against mating pin 3. In addition, the two longer sides of driver member 5 fit partially into annular recess 9 in mating pin 3. In this way a twofold mechanical connection is formed between mating pin 3 and socket member 1—on the one hand a pressure connection, and on the other hand a keyed-in connection.

Obviously the fixing technique which is described here as applied to a two-component (pin-and-socket) connector can also be transferred to other technical applications, while still remaining within the framework of this patent. An example would be the application of the technique to hub and axle technology.

What is claimed is:

1. An electrical connection device comprising:

an electrical socket member including a termination area for the connection of an electrical cable, and a termination area for the connection of an electrical cable, and a contact area having several tines capable of resilient deformation;

an electrical mating pin which is received by the contact area, the mating pin having at least a partial recess;

a driver element which at least partially surrounds the contact area loosely in its first functional position and tightly in its second functional position so that the tines are urged against the mating pin due to a contraction of the driver element, thereby providing a pressure fit with the mating pin, whereby in the second functional position the driver element fits partially into the recess of the mating pin so that a keyed-in connection is made with the mating pin as well as the pressure fit.

2. The electrical connection device according to claim 1, characterized by the fact that tines (6) of socket member (1) are at least somewhat narrower than the mating pin (3) at the point where driver member (5) fits partially into recess (9).

3. The electrical connection device according to claim 1, characterized by the fact that driver member (5) is in the form of a closed ring.

4. The electrical connection device according to claim 3, characterized by the fact that driver member (5) is oval in shape.

5. The electrical connection device according to claim 1, characterized by the fact that tines (6) of socket element (1) exhibit retaining wedges (8), which retain driver member (5) against contact area (4) so that driver member (5) cannot become detached.

6. The electrical connection device according to claim 1, characterized by the fact that contact area (4) of socket element (1) exhibits two tines.

7. An electrical connection device consisting of an electrical socket element and an electrical mating pin, in which the electrical socket element is provided with a termination area for the connection of an electrical cable and with a contact area for reception of the mating pin, the contact area exhibiting several tines capable of resilient deformation, a separate driver member of heat recoverable material, the driver member at least partially surrounding the contact area loosely in its first functional position, and in its second functional position at least partially surrounding the contact area such that the tines are pressed strongly against the inserted mating pin, characterized by the fact that at least one locking element (14) prevents driver member (5) from transferring from its first to its second functional position or from being activated in any other way before this is desirable.

8. The electrical connection device according to claim 7, characterized by the fact that the at least one locking element (14) is provided on contact area (4) and positioned in relation to driver member (5) that the recovery process of driver member (5) is prevented in one particular direction.

9. The electrical connection device according to claim 7, characterized by the fact that driver member (5) is retained against contact area (4) near the end not directly connected to the termination area such that driver member (5) cannot be detached and that the at least one locking element (14) is formed onto the free end of contact area (4).

10. An electrical connection device consisting of an electrical socket element and an electrical mating pin, in which the electrical socket element is provided with a termination area for reception of the mating pin, the contact area exhibiting several tines capable of resilient deformation, a separate driver member manufactured of heat recoverable material acting on the contact area, the driver member at least partially surrounding the contact area loosely in its first functional position, and in its second functional position at least partially surrounding the contact area such that the tines are pressed strongly against the inserting mating pin, characterized by the fact that contact area (4) of socket element (1) exhibits two tines (6) and that at the end of each tine (6) is formed a locking device (14) in the shape of a finger, the free ends of the fingers directly touching each other in the locked position, and the locking function being suspended by misalignment of these ends in relation to one another.

11. The electrical connection device according to claim 1, wherein the driver element is oval in shape and has two opposite long sides which partially fit into the recess of the mating pin.

12. The electrical connection device according to claim 11, wherein the recess has a bottom portion which is of a depth such that the driver member does not rest on the bottom portion when the driver member is in its second functional position.

13. The electrical connection device according to claim 10, characterized by the fact that the at least one locking element (14) is formed as an end stop for mating pin (3).

14. The electrical connection device according to claims 1 or 10, characterized by the fact that recess (9) on the mating pin (3), which interacts with driver member (5), is formed as a continuous circumferential groove.

15. An electrical connection device, consisting of an electrical socket member and an electrical mating pin, in which the electrical socket member is provided with a termination area for the connection of an electrical cable and with a contact area for reception of the mating pin, the contact area exhibiting several tines capable of resilient deformation, a separate driver element acting on the contact area, the driver element at least partially surrounding the contact area loosely in its first functional position and in its second functional position at least partially surrounding the contact area such that the tines are pressed strongly against the inserted mating pin due to a contraction of the driver element characterized by the fact that the mating pin (3) is supplied with at least a partial recess (9) and that the tines (6) and the driver member (5) are formed and positioned in relation to each other such that driver member (5) fits partially into recess (9) in its second functional position, whereby both a pressure connection and a keyed-in connection is made with the mating pin (3).

16. The electrical connection device according to claim 15, characterized by the fact the driver element is a mechanically movable eccentric device.

17. A method for providing an electrical connection of an electrical cable comprising the steps of:

providing an electrical connection device including an electrical socket member having a contact area with several tines capable of resilient deformation, retaining wedges disposed on the tines, an electrical mating pin with a partial recess, and a driver element which at least partially surrounds the contact area loosely in its first functional position and tightly in its second functional position so that the tines are urged against the mating pin;

placing the driver element into its first functional position;

positioning the driver element between the retaining wedges so that it cooperates with the contact area associated with the tines, thereby urging the tines toward each other, the tines springing back to their original position when the driver is rested against the retaining wedges, so that the driver member is securely retained adjacent the contact area between the wedges;

aligning the mating pin with the socket member;

inserting the mating pin into the socket member until a retaining tongue thereof engages into a tongue recess disposed within the socket member so that an optimum electrical contact is made; and urging the driver member inwardly so that it moves into its second functional position, wherein the driver member urges the tines inwardly, so that the tines engage the mating pin and the driver member rests partially within the recess of the mating pin, thereby providing a mechanical connection between the mating pin and the socket member which includes a pressure connection supplemented by a keyed-in connection.

* * * * *